US005771495A

United States Patent [19]

Turner et al.

[11] Patent Number: 5,771,495

[45] Date of Patent: Jun. 30, 1998

[54] SNOWBOARDING SOCK

[75] Inventors: George F. Turner, Alfreton; Colin Nash, Stonebroom, both of England

[73] Assignee: The Burton Corporation, Burlington, Vt.

[21] Appl. No.: 584,014

[22] Filed: Jan. 8, 1996

[51] Int. Cl.[6] ..... A41B 11/00

[52] U.S. Cl. ..... 2/239; 66/184; 66/187

[58] Field of Search ..... 2/239; 66/183, 66/184, 185, 186, 187

[56] References Cited

U.S. PATENT DOCUMENTS

| | | | |
|---|---|---|---|
| 2,144,563 | 1/1939 | Davis | 66/185 X |
| 3,386,270 | 6/1968 | Simmons | 66/183 X |
| 3,793,851 | 2/1974 | Thorneburg | 66/185 |
| 4,255,949 | 3/1981 | Thorneburg | 2/239 X |
| 4,373,361 | 2/1983 | Thorneburg | 66/183 X |
| 5,133,088 | 7/1992 | Dunlap | 2/239 X |
| 5,307,522 | 5/1994 | Throneburg et al. | 2/239 |
| 5,335,517 | 8/1994 | Throneburg et al. | 66/185 |
| 5,421,034 | 6/1995 | Keune | 2/239 |

FOREIGN PATENT DOCUMENTS

| | | |
|---|---|---|
| 55-132701 | 10/1980 | Japan . |
| 57-171702 | 10/1982 | Japan . |
| 5-10402 | 2/1993 | Japan . |

OTHER PUBLICATIONS

Technical Evaluation Report and English Translation.

*Primary Examiner*—C. D. Crowder
*Assistant Examiner*—Shirra L. Jenkins
*Attorney, Agent, or Firm*—Wolf, Greenfield & Sacks, P.C.

[57] ABSTRACT

A forward lean sock, that is particularly suited to snowboarding is provided. The snowboarding sock includes a woven sock body having a leg section and a foot section joined by a heel and front arch. The heel includes a Y-heel construction that provide an enhanced pouch of material at the heel to remove tension at the opposing front arch so that bunching is minimized in a forward lean position. The toe section can include reduced padding or a flat weave with no padding to provide more freedom of toe movement for the wearer.

21 Claims, 3 Drawing Sheets

SNOWBOARDING SOCK

FIELD OF THE INVENTION

The present invention relates generally to a sock that is suited to the sport of snowboarding.

BACKGROUND OF THE INVENTION

In snowboarding, the rider uses both feet to manipulate the snowboard down a slope. Essential to proper control of the snowboard is the maintenance of well-balanced stance. Such a stance, generally, requires the rider to lean slightly forward, with ankles bent forwardly. Snowboarding boots are constructed to facilitate such a forward bend or lean.

While a forward lean is often desirable in the sport of skiing, skiers are more generally restrained in a forward-lean position by very rigid boots. Conversely, snowboarding boots are substantially more flexible and allow the rider's ankle to rock forwardly and backwardly as needed.

It is now recognized that conventional skiing and athletic socks are not well-suited to the sport of snowboarding. These socks tend to include too much padding at the toe area, which detracts from a good snowboard "feel" or feedback of conditions. Conventional socks also tend to bunch up at the front arch between the ankle and instep as the rider attempts to lean forward. This bunching up of fabric increases as the rider rocks back and forth between a rearward and forward leaning position.

A snowboarding sock is disclosed in U.S. Pat. No. 5,307,522 to Throneburg et al. This document is expressly incorporated herein by reference. Throneburg et al. recognizes a particular padding placement, such as ankle and calf padding, desired for the sport of snowboarding. However, this reference does not address the problems posed by a forward lean position. Throneburg et al. also provides a fully padded toe area which goes against the desire for enhanced feel in the toe area.

The sock of Throneburg et al. and other conventionally-formed socks utilize a knitting process in which a tubular knitting machine employing "needles" creates a woven tube. The size of the tube is determined, generally, by the number of needles employed, wherein more needles create a larger tube. Bunching of material at the ankle in a forward lean position occurs largely because the heel of a conventional athletic or skiing sock is formed simply by reducing the number of needles up until the turn of the heel and then, subsequently, increasing the number of needles around the turn of the heel toward the toe. Thus, there is often not enough "material" present at the heel to prevent pulling at the front arch between the ankle and instep.

It is, therefore, an object of this invention to provide a sock that is particularly suited to the sport of snowboarding. The sock can be arranged to limit bunching of fabric at the front archwhen the rider is in a forward leaning position. The sock should include appropriate padding where necessary for proper support and comfort, but such padding may be limited where unnecessary and where it would detract from a rider's feel of the snowboard.

SUMMARY OF THE INVENTION

This invention overcomes the disadvantages of the prior art by providing a sock for snowboarding having an enlarged "Y-heel" pouch that relieves material bunching in a forward lean position. Padding can be omitted from the toe area of the sock for enhanced control. The snowboarding sock can include one or both of the features of a Y-heel and a thinly padded toe section.

In one embodiment, a snowboarding sock includes a tubular sock body having a leg section and a foot section with a heel positioned between the leg section and the foot section and a front arch opposite the heel between the leg section and the foot section. There is an enclosed toe at an end of the foot section opposite the heel. The sock body includes at least a high density of padding and a low density of padding at predetermined locations thereon. A portion of the leg section adjacent a rear calf includes the high density of padding and the toe includes the low density of padding for enhanced toe movement. The sock of this embodiment can be constructed so that sock body material is less likely to bunch up at the front arch by providing an enlarged material pouch at the heel. This material pouch is provided using a construction technique known as the "Y-heel". The Y-heel is formed by a conventional process using a tubular hosiery knitting machine that increases the number of needles employed at the heel section to create more material.

In another embodiment, the sock can include the Y-heel construction for an enhanced forward lean with or without the lower density padding at the toe section.

In any embodiment, the low density of padding can comprise a flat weave of sock body material according to this invention, so that the toe is formed with essentially a flat weave. Likewise, the high density of padding can comprise a terry material formed from loops of yarn applied to the sock body by a terry piece on the hosiery knitting machine.

A middle density of padding can also be provided to portions of the sock body. The middle density of padding can also comprise a terry. The yarn density of the terry of the high density of padding is generally less than the yarn density of the terry of the middle density of padding. The loop size of the two terries can be approximately the same. The middle density of padding can be located along the instep of the foot section and adjacent an uppermost and lowermost portion of the rear of the leg section. According to this embodiment, the high density of padding located at the rear calf can be positioned to contact an upper edge of a snowboarding boot. In addition, a high density of padding can be located along the entire front of the leg section.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION OF THE PREFERRED EMBODIMENT

Figure 1:
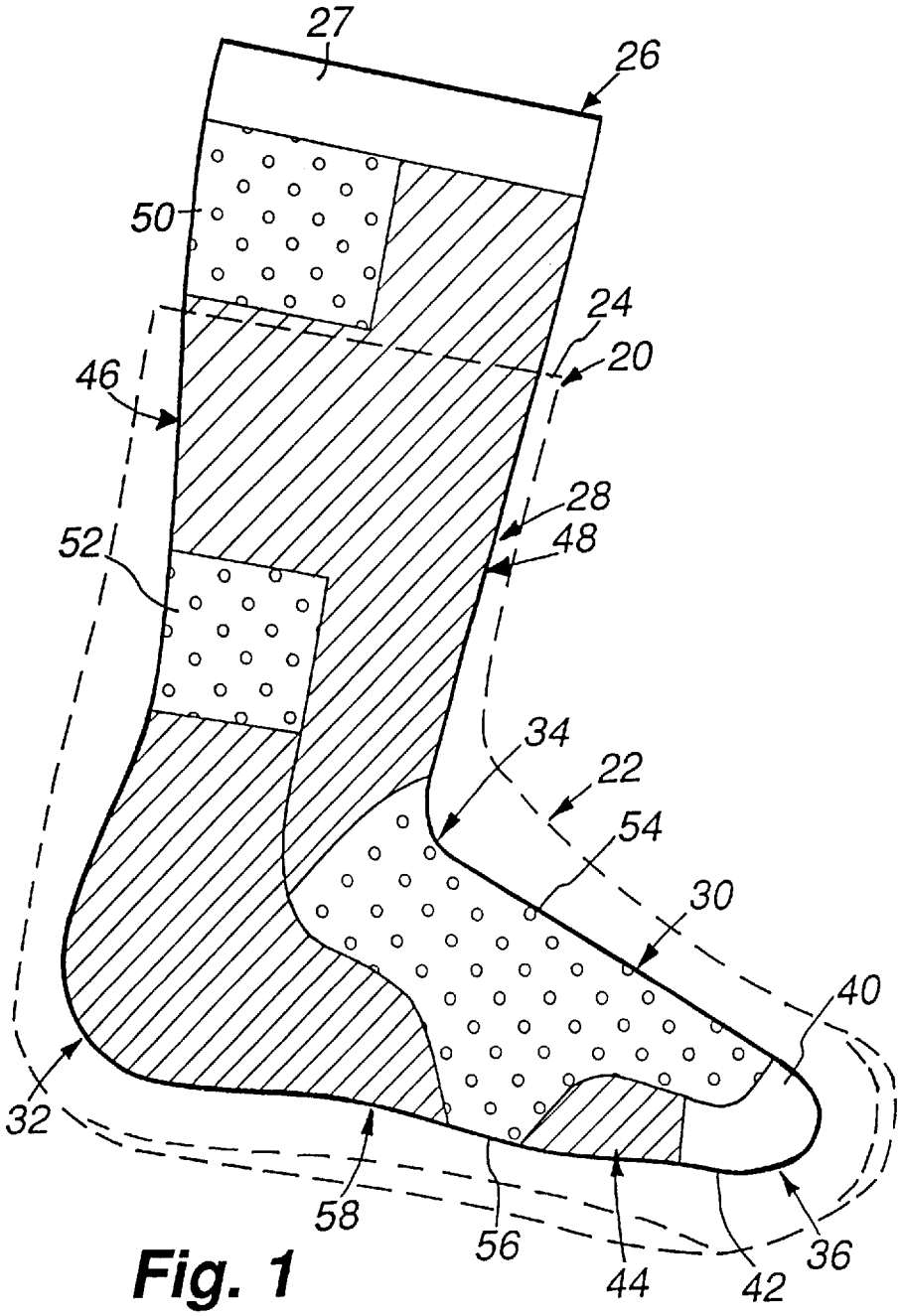
FIG. 1 is a schematic side view of a snowboarding sock with a snowboarding boot shown schematically in phantom according to this invention.

FIG. 1 schematically illustrates a sock, particularly suited for snowboarding. The sock 20 is shown in side view in a "flattened" orientation. The outline of a snowboarding boot 22 is shown in phantom for reference purposes. The upper edge 24 of the boot 22 generally terminates below the open top 26 of the sock 20. This top generally includes an appropriately sized elastic band 27 stitched or woven to the sock body. The sock consists generally of a leg section 28 that extends upwardly along the ankle and calf and a foot section 30 that covers the instep, sole, and toes of the foot. Between the foot section 30 and leg section 28 is located the heel 32 and the opposing front arch 34. The toe 36 of the sock is closed off to seal the front of the foot section. FIG. 1 relates primarily to the padding relationship of the sock. The construction of the sock is discussed more generally below. In this embodiment, the sock is constructed from a nylon-Lycra® blend, but any combination of wool, cotton and synthetic fabrics can be substituted according to this invention.

The basic weave of the sock 20 according to this invention comprises a 2–4 percent Lycra® and 96–98 percent nylon blend. The Lycra® gives elasticity to the nylon. The knitting of the basic weave of the sock or "sock body" is conventional and formed on a tubular hosiery knitting machine to be described further below. Various portions of the base weave are augmented with a plush or "padded" material that, in this embodiment comprises a terry. By "terry", it is meant a plush fabric formed with elongated loops of yarn or thread. In this embodiment, the terry is a wool-nylon blend comprising 85 percent wool and 15 percent nylon, approximately. Two different densities of terry are used according to this invention to create two distinct padding levels. In this embodiment, there are, in essence, three levels of padding—"low", or no padding where the flat weave predominates, "middle" level of padding where a low density terry is used and "high" density padding where a high density of terry is used. FIG. 1 diagrams a preferred embodiment for the various padding levels. The toe 36 includes essentially no padding according to this invention. A flat weave is provided along the last inch of the top 40 of the toe and along approximately 2 inches of the bottom 42 of the toe according to this embodiment. It has been recognized that, in the sport of snowboarding, the rider's ability to move his or her toes aids in gaining proper feel and control of the snowboard. Too much padding has been found to overly restrain toes and prevent movement or "wiggling" of toes which detracts from the rider's feel of the snowboard. A high density of padding (as denoted by cross-hatched lines) is provided on the bottom behind the toe 36 adjacent the ball of the foot 44. A high density of padding is also provided at the heel 32 where cushioning is desirable.

Most significantly, high padding is provided at the rear calf 46 along the leg section 28. The padding of the rear calf 46 insures that the upper edge 24 of the snowboard boot 22 does not chafe or bruise the rider as he or she rocks back and forth. Similar padding is extended along the front 48 of the leg section 28. According to this invention, the left and right sides of the flattened sock shown in FIG. 1 are substantially similar.

A middle density of padding (as denoted by circles) is also utilized where a full thickness of padding is unnecessary, and where added feel is desirable. Between the heavy calf padding 46 are an uppermost and lowermost rear middle density of padding 50 and 52, respectively. The middle density of padding is constructed from a lower density yarn or thread that forms a terry according to this embodiment. The terry of this embodiment for both the high density and middle density are of similar pile height. In this embodiment, the pile height is approximately 2–3 millimeters in height from the flat weave. Another middle density of padding is located along the instep 54 and extends from the toe 36 to the front arch 34 along the upper portion of the foot section 30. This middle density of padding extends around the bottom of the foot between the heel and the ball section 44 of the foot along a relatively narrow 1–2 inches strip 56 along the bottom. This strip 56 is generally located out of contact with the surface of the snowboarding boot 22 as it is located along the lower arch of the foot. Note that other methods of providing different levels of padding are expressly contemplated.

Figure 2:
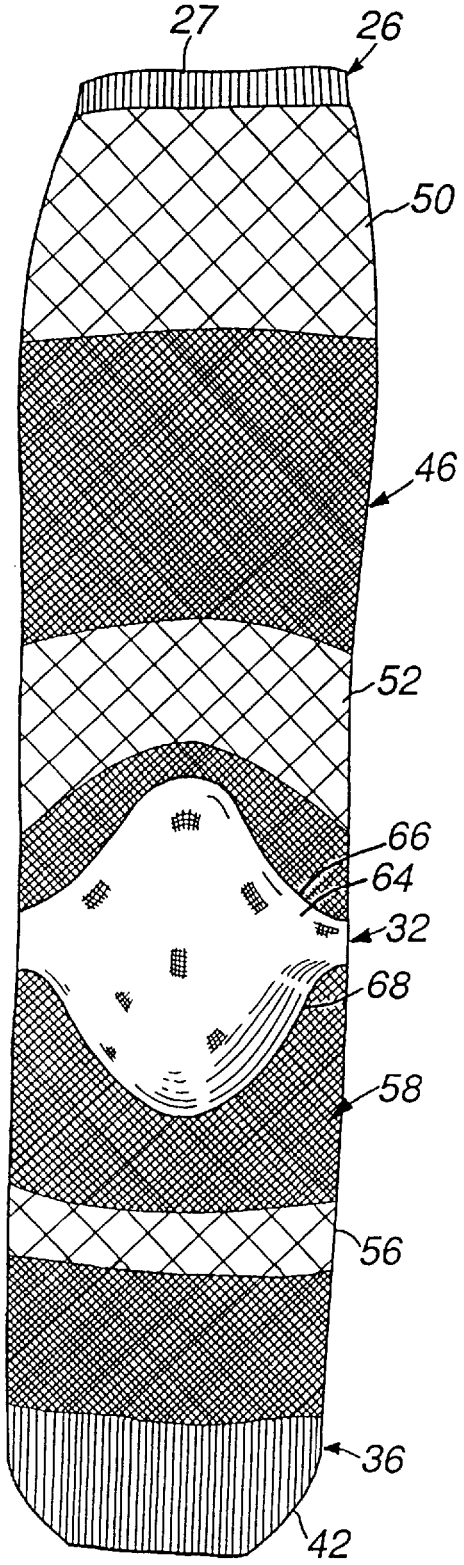
FIG. 2 is a schematic rear view of the snowboarding sock of FIG. 1 detailing the Y-heel pouch.
Figure 3:
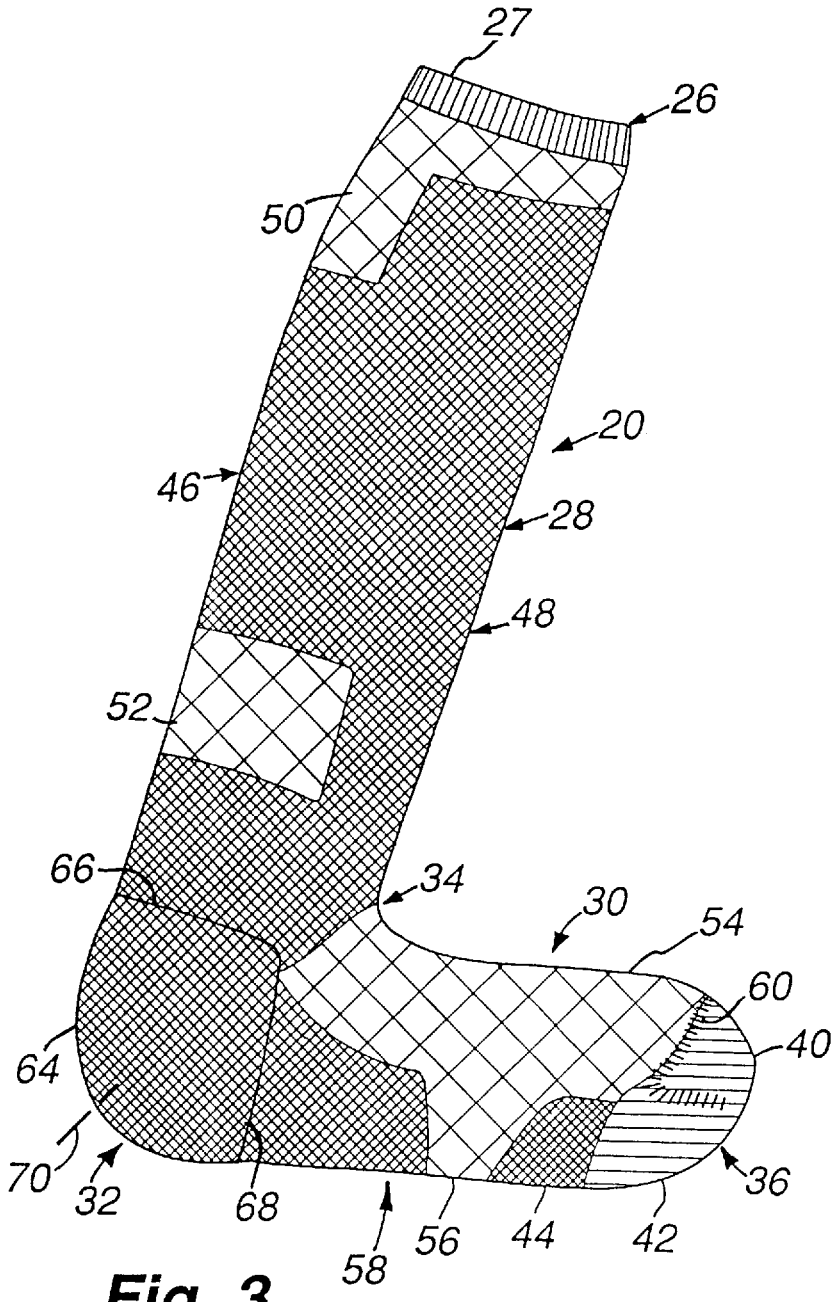
FIG. 3 is a schematic side view of a snowboarding sock detailing the Y-heel section according to this invention.

The sock 20 according to this invention is shown in more detail in FIGS. 2 and 3 in a flattened rear view (FIG. 2) and side view (FIG. 3). As discussed above, a sock according to this embodiment is constructed using a conventional hosiery knitting machine (not shown). An exemplary sock was constructed using an 5CUS model electronic hosiery knitting machine with a sandwich terry knitting head provided by San Giacomo S.P.A. of Brescia, Italy. This machine includes a terry piece or head that enables the selective application of terry padding to portions of the sock. It knits hosiery in the form of a tube using needles to provide weft to the tubular knit.

The needles can number up to approximately 80 or 90 and are operable in groupings, or each independently by a computer program that applies yams or threads based upon a predetermined design specifications. These elements are conventional. In forming the sock body of the sock 20 according to this embodiment, the knitting machine adds needles (e.g. threads) where wider areas are desired. Note that the upper portion of the sock is wider to accommodate the calf. Thus, more needles are added at this location. Fewer needles are added where a narrower tube is desired such as adjacent the lower end of the leg section 28 near the front arch 34 and at the toe section 36. By applying a "terry piece" to the knitting machine according to this embodiment, the terry pile loops can be added to form padding. As noted above, the terry loops comprise a wool/nylon blend. A cotton/synthetic blend or any other desired blend of plush fabric can be utilized according to this invention. In this embodiment, the pile of the heavier density and middle density padding areas have the same height (approximately 2–3 millimeters). The density of the padding is varied by varying the yarn size/density. In this embodiment, the middle density of padding is formed using a two-ply worsted yarn measuring 2/26 Wc. The middle density of padding uses a lighter density two-ply worsted yarn measuring 2/36 Wc.

Terry padding is applied by the knitting machines terry piece based upon computer control instructions. The computer can accurately outline the locations along the tubular sock body in which the various padding pile is to be applied. As noted above, some variation in padding is contemplated according to this invention. For the purpose of snowboarding, padding is significant at the rear calf 46, the heel 32 and along the front of the leg section 48. The exact extent of padding can be varied depending upon the size of the sock, the length of the foot section 28 and the preference of the designer. Additionally, yarns and piles can be provided in a variety of colors (not shown). Stripes can be provided in different color piles and underlining weaves according to one embodiment. Logos can be provided to any portion of the sock body including the bottom 58 of the foot section 30.

As noted above, part of the terry application process can include the omission of padding from the toe 36. The toe is formed, generally, by tapering the sock body to an end point and then subsequently knitting or stitching along a seam 60 (FIG. 3) at the toe. The tapering process can include a knitting machine command to alternate needles on each course of weft. In other words, for any given course, only half the normal number of needles are employed and needles in each course are reduced by one or more as the courses proceed down the taper to the end of the toe. In other words, needles on one half of the sock engage on one course, followed only by needles on another half of the sock. With each repetition, one or more needles from each side are disengaged, forming a gradual taper. At no time is terry applied to the toe section 36 and a flat weave is maintained. As defined herein, this is considered a "low" density of padding since the only padding is the flat weave itself. It is contemplated, however, that in some embodiments, further padding may be applied to the toe, but this padding, in general, will remain lower in density than the padding applied to other areas of the sock body.

FIGS. 2 and 3 detail the heel 32 of the sock 20 according to this invention. As described above, the heel can be formed with a high density of padding and a "Y-heel" construction. The Y-heel construction is known generally in hosiery and constructed according to a known process using the above-described hosiery knitting machine. The Y-heel forms, generally, an enlarged pouch 64 that provides more material to the heel 32 than would be provided by a conventional straight heel seam. The Y-heel is so called because the pouch is defined within a pair of extended seam lines 66 and 68 that delineate the pouch 64 from the remainder of the heel. The pouch may comprise all or only part of the total curve of the heel. The exact size of the pouch is generally determined based upon the size of a given sock and how it responds to movement of a foot relative to a leg by a test subject's foot relative to his or her leg. The heel in a conventional sock is formed similarly to the toe in that one half of the needles are employed for each course and the number of needles are decreased by one or more needles per course until the center of the heel's curve is reached. The number of needles are then gradually increased again by one or more needles to complete the curve of the heel. Such a process would form a straight seam between sock halves. The Y-heel according to this invention forms a larger-sized pouch 64 by providing an intermediate increase in the number of needles, incrementally (one or more needles per course) following an initial decrease to turn the corner of the heel. The number of needles are subsequently decreased adjacent the center point 70 of the heel pouch 64, but the decrease is based upon the number of needles formed by the increase for the pouch. In other words, the needles begin decreasing from a higher number than would exist in a conventionally-formed heel.

While the Y-heel is, itself, formed according to a known process, it yields an unexpected result in connection with a sock suited for snowboarding. As discussed above, the front arch 34 will bunch up with sock body material, particularly when heavy padding is utilized if the tension of the material is not redistributed. By providing an enlarged pouch 64 at the heel 32, the tension forces acting on the heel are redistributed and more room is available for stretch of the sock body fabric during a forward lean movement. In FIG. 3, such a forward lean is shown. The Y-heel construction uniquely provides such a pouch. Conversely, a straight seam cannot, generally, be constructed to relieve stresses at the front arch 34 similarly to the Y-heel pouch 64. If a straight seam heel is constructed overly large, then the heel area of the sock will bunch with sock body fabric. If too small, then the stresses that cause bunching at the front arch 34 are not alleviated. While other solutions, such as adding a heel section by subsequent sewing or knitting can be employed, they are not practical when producing or when manufacturing mass-produced hosiery, where additional knitting and sewing steps should be avoided.

The foregoing has been a detailed description of a preferred embodiment. Various modifications and equivalents can be made without departing from the spirit and scope of this invention. For example, a variety of synthetic and natural fibers and fiber blends can be utilized to form a forward leaning sock according to this embodiment. The sock can be constructed in a variety of sizes with a variety of ankle lengths. The density of padding can be varied for differing conditions and wear characteristics. Likewise, a variety of colors and graphic designs can be applied to a sock using either screen printing processes, dyes or, preferably, various colored yarns that are knit into the sock. Further, a snowboarding sock, according to the present invention, can include one or both of the features of a Y-heel construction and a low density of padding at the toe section. This description is, therefore, meant to be taken only by way of example and not to otherwise limit is the scope of the invention.

What is claimed is:

1. A snowboarding sock comprising:

a tubular sock body having a leg section including a front portion and a rear calf portion and a foot section including a bottom portion and an instep portion, a heel between the leg section and the foot section, an enclosed toe at an end of the foot section opposite the heel, and a ball of the foot adjacent the toe;

the sock body including at least a high density of padding and a low density of padding at predetermined locations thereon in a predetermined arrangement appropriate to engagement of the sock to and within a snowboarding boot; and wherein the low density of padding is provided on at least the bottom portion of the foot section along at least the toe for enhanced toe movement and the high density of padding is located on at least a rear calf portion of the leg section, which contacts the upper portion of the snowboarding boot to prevent chafing between the upper portion of the snowboarding boot and a wearer's leg.

2. The snowboarding sock as set forth in claim 1 further comprising a Y-heel construction at the heel including an enlarged material pouch at the heel whereby tension is removed from a front arch between the foot section and the leg section opposite the heel so as to reduce bunching of the sock in a forward lean position.

3. The snowboarding sock as set forth in claim 3 wherein the low density of padding comprises a flat weave of material.

4. The snowboarding sock as set forth in claim 1 wherein the high density of padding comprises a terry material.

5. The snowboarding sock as set forth in claim 4 further comprising a middle density of padding between the high density of padding and the low density of padding, the middle density being located adjacent an instep of the foot section and adjacent an uppermost and lowermost portion of a rear of the leg section.

6. The snowboarding sock as set forth in claim 5 wherein the middle density of padding comprises a terry having a yarn density that is less than a yarn density of the terry of the high density of padding.

7. The snowboarding sock as set forth in claim 1 further comprising a high density of padding located about a front of the leg section.

8. The snowboarding sock as set forth in claim 1 further comprising an elastic band located at an uppermost, open portion of the leg section.

9. A snowboarding sock provided with a forward lean comprising:

a tubular sock body having a leg section and a foot section, a heel at an opposing front arch located between the leg section and the foot section and an enclosed toe at an end of the foot section opposite the heel section;

a Y-heel construction located at the heel including a pocket of material which is enlarged at the heel, with respect to a standard Y-heel cnstruction whereby a wearer's foot applies reduced tension at the front arch so that bunching of the sock body at the front arch is minimized at an angle of forward lean that is commonly obtained during snowboarding; and wherein the sock body includes at least a high density of padding and a low density of padding in a predetermined arrangement appropriate to engagement of the sock to and within a snowboarding boot.

10. The forward lean sock as set forth in claim 9 wherein the high density of padding is located adjacent a rear calf portion of the leg section.

11. The forward lean sock as set forth in claim 9 wherein the low density of padding comprises a flat weave.

12. The forward lean sock as set forth in claim 10 wherein the toe includes a low density of padding along a bottom portion thereof.

13. The forward lean sock as set forth in claim 12 wherein the heel includes a high density of padding.

14. The forward lean sock as set forth in claim 13 wherein the high density of padding comprises a terry material having a first density.

15. The forward lean sock as set forth in claim 14 further comprising a middle density of padding having a second density that is less than the first density, the middle density of padding being located at an instep of the foot section.

16. The forward lean sock as set forth in claim 15 wherein the leg section includes the middle density of padding at an uppermost portion of the leg section and lowermost portion of the leg section.

17. The forward lean sock as set forth in claim 11 wherein the high density of padding at the rear calf of the leg section is constructed and arranged to engage an upper portion of a snowboarding boot and to provide padding between a wearer's leg and the snowboarding boot.

18. The snowboarding sock as set forth in claim 1 further comprising a low density of padding located at a top portion of the toe section, opposite the bottom portion.

19. The snowboarding sock as set forth in claim 1 further comprising a high density of padding located at the heel.

20. The forward lean sock as set forth in claim 12 wherein the toe further includes a low density of padding along a top portion thereof.

21. The forward lean sock as set forth in claim 10 wherein the ball of the foot includes a low density of padding.

* * * * *